US008602925B1

(12) United States Patent
Rickon, Jr.

(10) Patent No.: US 8,602,925 B1
(45) Date of Patent: Dec. 10, 2013

(54) GRIP TRAINING DEVICE

(76) Inventor: James Franklin Rickon, Jr., Hudson, OH (US)

( * ) Notice: Subject to any disclaimer, the term of this patent is extended or adjusted under 35 U.S.C. 154(b) by 258 days.

(21) Appl. No.: 13/065,680

(22) Filed: Mar. 28, 2011

Related U.S. Application Data

(60) Provisional application No. 61/341,161, filed on Mar. 29, 2010.

(51) Int. Cl.

| | |
|---|---|
| ***A63B 59/06*** | (2006.01) |
| ***A63B 49/08*** | (2006.01) |
| ***A63B 53/14*** | (2006.01) |
| ***A63B 59/02*** | (2006.01) |
| ***A63B 69/36*** | (2006.01) |

(52) U.S. Cl.
USPC ..... 473/568; 473/551; 473/300; 473/513; 473/203

(58) Field of Classification Search
USPC ..... 473/457, 568, 549–552, 203, 204, 473/300–303; 81/489; 16/421, 430
See application file for complete search history.

(56) References Cited

U.S. PATENT DOCUMENTS

| | | | | | |
|---|---|---|---|---|---|
| 715,225 | A | | 12/1902 | Whitner | |
| 1,075,054 | A | | 10/1913 | Morley | |
| 1,690,312 | A | | 11/1928 | Rosan | |
| 2,223,437 | A | | 12/1940 | Yeager, Jr. | |
| 2,780,464 | A | * | 2/1957 | Ashley | 473/206 |
| 2,962,288 | A | | 11/1960 | Lowden | |
| 3,036,836 | A | | 5/1962 | Mason | |
| 3,084,938 | A | | 4/1963 | Kapanowski | |
| 3,203,697 | A | * | 8/1965 | Berzatzy | 473/538 |
| 3,227,455 | A | | 1/1966 | Hulsman | |
| 3,256,023 | A | | 6/1966 | Frazelle | |
| 3,606,325 | A | | 9/1971 | Lamkin et al. | |
| 3,817,521 | A | * | 6/1974 | Wright | 473/551 |
| 4,072,311 | A | * | 2/1978 | Bertucci | 473/551 |
| 4,226,418 | A | * | 10/1980 | Balfour | 473/551 |
| 4,402,508 | A | | 9/1983 | Pflueger | |
| 4,648,196 | A | | 3/1987 | Moody | |
| 4,804,181 | A | | 2/1989 | Foster | |
| 4,836,544 | A | | 6/1989 | Lai | |
| 4,848,746 | A | | 7/1989 | Klink | |
| 4,850,079 | A | * | 7/1989 | Thompson | 16/421 |
| 4,961,572 | A | * | 10/1990 | Badillo et al. | 473/538 |
| 4,981,297 | A | | 1/1991 | Foster | |
| D321,233 | S | | 10/1991 | Fenton | |
| 5,143,375 | A | | 9/1992 | Wilkins | |
| 5,180,165 | A | * | 1/1993 | Frost | 473/206 |
| D333,333 | S | | 2/1993 | Solheim | |
| 5,184,815 | A | | 2/1993 | Maddox | |
| D334,224 | S | | 3/1993 | Downey | |
| 5,377,984 | A | | 1/1995 | Ciccia | |
| 5,480,146 | A | | 1/1996 | Comer | |
| 5,839,983 | A | | 11/1998 | Kramer | |
| 6,152,831 | A | * | 11/2000 | Arcenas | 473/206 |
| 6,305,051 | B1 | * | 10/2001 | Cho | 16/430 |

(Continued)

*Primary Examiner* — Mark Graham
(74) *Attorney, Agent, or Firm* — D. Peter Hochberg; Sean F. Mellino; Richard A. Wolf

(57) ABSTRACT

A grip teaching device for encouraging an individual to maintain a proper grip of sporting equipment. The grip teaching device has a body member for placement onto the sporting equipment and can be secured by a securing device, such as a strap. The grip teaching device also includes an index finger receiving area which receives the individual's index finger to promote an appropriate placement of the index finger, and in turn forces the remaining fingers into proper alignment.

20 Claims, 8 Drawing Sheets

(56) References Cited

U.S. PATENT DOCUMENTS

| | | | | |
|---|---|---|---|---|
| 6,321,417 | B1 * | 11/2001 | Zhang | 16/430 |
| 6,482,113 | B1 * | 11/2002 | Finn | 473/551 |
| 6,916,260 | B1 * | 7/2005 | Poteet | 473/551 |
| 6,923,727 | B1 | 8/2005 | Jacobs | |
| 7,125,353 | B2 | 10/2006 | Blount | |
| 7,351,167 | B1 | 4/2008 | Hathaway | |
| 7,446,280 | B2 * | 11/2008 | Zamuner | 219/137.31 |
| D598,513 | S | 8/2009 | Bleecker | |
| 7,572,198 | B2 | 8/2009 | Bleecker | |
| 7,758,455 | B2 | 7/2010 | Thomas | |
| 2005/0266942 | A1 * | 12/2005 | Failla Colonnello Seppi et al. | 473/551 |
| 2005/0272537 | A1 | 12/2005 | Kramer | |
| 2007/0254753 | A1 * | 11/2007 | Bleecker | 473/568 |
| 2009/0042660 | A1 * | 2/2009 | Shaw | 473/203 |
| 2010/0151975 | A1 | 6/2010 | Hisle et al. | |

* cited by examiner

GRIP TRAINING DEVICE

CROSS-REFERENCE TO RELATED APPLICATION

This application claims priority of U.S. Provisional Application No. 61/341,161, filed Mar. 29, 2010, under Title 35, United States Code, Section 119(e), which is incorporated by reference herein in its entirety.

FIELD OF THE INVENTION

The present invention generally relates to sporting good equipment for use as a grip teaching aid or training device. More particularly, the present invention relates to a teaching aid or training device for facilitating and developing the proper grip of a handle of sporting equipment or other devices having a handle, such as a baseball bat handle, for use by either right-handed or left-handed individuals. The present invention could be used as a grip for a handle of sporting equipment, or any other device having a handle.

DESCRIPTION OF THE PRIOR ART

Many different sports and activities require the use of equipment that is swung to strike an object, such as a baseball bat for baseball, a softball bat for softball or a golf club in golf. The individual's grip on the particular equipment, such as the baseball bat, is typically important for proper swinging motion and striking ability on the object. It is well known in the art of sporting goods to provide gripping aids for encouraging a proper grip of the handle of the equipment, such as the handle of a baseball bat, softball bat or golf club.

One of the most common and leading causes of inconsistencies in athletic swings in baseball, softball and golf are the grip and grip alignment. In many instances, the positioning of the hand and the pressure applied to the grip will determine the swing path toward the ball. Many individuals are unable to consistently grip the handle properly, which can lead to undesired results in the swing, such as uneven or inconsistent swing paths, or a weaker swing than had the individual used a proper grip.

In baseball or softball, for example, a proper grip on the bat is important to maximize strength and swinging motion for striking the baseball. A proper grip in baseball or softball is such that the bat is held primarily in the fingers of the hand so that the second row of knuckles (i.e., middle row of knuckles) of the individual are lined up with each other. A baseball or softball bat should not be held in the palm of the hands. Holding a baseball or softball bat in the palm of the hands inhibits the flexion of the wrists during the swing, and decreases the individual's natural power and quickness during the swinging motion. In addition, holding the bat in the palm encourages an improper swinging motion which can facilitate injury to the individual while swinging and can decrease the bat stability while swinging thereby decreasing power.

Various devices are known in the sporting goods art for promoting a proper grip. Many of these devices, for example, wrap around the handle and include a raised surface portion for aligning the hands. One known device in the art provides a bat grip that includes upper and lower separated segments that wrap completely around the bat handle and allow for the use of both hands by a left-handed or right-handed player and has a raised surface portion for knuckle alignment. This type of device, however, maintains a generally artificial feel with respect to the bat handle and prevents the individual from obtaining the natural feel of the bat. It can also be difficult to easily put on the bat or remove from the bat.

Other devices known in the art comprise baseball grips of a material which enhances the user's hold on the bat, e.g., rubber or neoprene materials. Grips have been formed such that they conform to the hands of the user while other grips have indentions for receiving the user's fingers in such a way that the bat is more easily gripped. These types of grips, however, do not typically allow for the user to maintain a natural feel of the bat handle. These known grips can also be cumbersome and difficult to apply to or remove from a bat handle.

A number of grips exist for instructing a user on how to properly grip a baseball bat, golf club, tennis racket, or other similar such sporting equipment. Grips specifically configured for instructing an individual on how to properly grasp the equipment are generally known in the art. For example, U.S. Pat. No. 7,125,353 (Blount) discloses a baseball bat grip that encourages a user to maintain a proper grip throughout the entire swing of the baseball bat. The grip includes a pair of protrusions that are secured between a V-shaped opening between the user's index finger and thumb on each hand. The grip further includes certain ridges and valleys configured to receive the user's fingers to further maintain an appropriate grip.

Such grips suffer from a number of disadvantages. In particular, these grips do not properly instruct a user on how to position the baseball bat such that when the user swings the baseball bat, the so-called trademark portion of the bat is positioned correctly with respect to the user's hands and with respect to the batted ball. Further, the grip of the '353 patent suffers other disadvantages, namely, the V-shaped openings formed by the protrusions result in a grip that rests too deeply into the user's hand, thus requiring that the user to control the bat with the palm of the user's hand instead of the fingers of the user's hand. Further, the ridges and valleys do not conform to the user's hand or instruct the user on where to position each of the user's respective fingers on the baseball bat. In addition, the '353 patent is configured to instruct a user on how to achieve a "knocked knuckles" grip throughout the swing. Such a "knocked knuckles" grip, however, can be disadvantageous because the "knocked knuckles" grip significantly reduces a user's ability to securely grasp the baseball bat and swing the bat in a controlled, powerful manner.

Other devices known in the art which include grips for sporting equipment cannot be easily installed on the sporting equipment due to the shape of such equipment. Specifically, a baseball bat includes a knob at a first end, a barrel at a second end, and a handle portion between the knob and the barrel. The user grips the baseball bat at the handle portion, and as such training aids for teaching and promoting proper grip are installed on the handle portion. The knob and barrel, however, are typically much larger in diameter than the handle portion. Thus, installing a grip known in the art is difficult, as the grip must be stretched over the knob, yet must retain a tight fit to the handle portion. Such known grips that accomplish this tend to become loose over time due to stretching. They too can be cumbersome to put on and remove.

Accordingly, there is an unsatisfied need in the art for a training device for encouraging a proper grip of a handle, such as a baseball bat handle, that can be interchangeable for a right-handed or left-handed individual, that is easily applied to and removed from a handle, and promotes as much direct contact between the individual's hands and the handle to allow close to a "natural feel" as possible during use.

SUMMARY OF THE INVENTION

The ability to provide a specific sensation and placement of the grip into the player's fingers during the set-up and the swing helps the player to develop and maintain the proper and most efficient grip for that given sport. The present invention provides the individual with the proper sensation and positioning for the index finger of the hand during the grip, while also forcing the rest of the player's fingers into the proper grip alignment directly on the handle. The index finger is also known as, and will be referred to as, the "trigger finger."

The present invention addresses the various disadvantages of known prior art training devices for promoting proper grip of a handle. The training device of the present invention generally includes a unitary member having a defined area for placement of the trigger finger, while simultaneously forcing the other fingers into proper alignment and which can be easily employed during use and can be adapted for use in any activity requiring a bat, racquet, club, etc., such as baseball, softball, golf, tennis, lacrosse, cricket, etc. It could also be used for non-sport related activities, such as using a scythe, a sledgehammer, a shovel, etc. The training device of the present invention can comprise a single unitary elongated tube-like body for fitting around the handle of a sporting equipment, such as a baseball bat, and can be comprised of any material known in the art such as vinyl, rubber, plastic, neoprene and the like.

In an embodiment of the present invention, the device includes a protruding saddle (i.e., trigger finger receiving area) defined by a finger groove portion. The player's "trigger finger" securely and comfortably fits into the trigger finger receiving area.

An embodiment of the present includes a device having a visual alignment guide on the rear portion. A visual alignment guide provides the individual with the proper sensation of control and position with the "trigger finger" during use.

It is an object of the present invention to provide an improved device for promoting proper grip and alignment (a gripping aid) of the hands on a baseball bat or other sporting equipment.

It is another object of the present invention to provide an improved gripping aid that can be easily placed onto or removed from a baseball bat or other sporting equipment.

It is yet another object of the present invention to provide an improved gripping aid that can be easily interchangeable for use by a right-handed individual or a left-handed individual.

It is still yet another object of the present invention to provide an improved gripping aid that allows for a substantial amount of direct contact between a baseball bat or other sporting equipment and the individual's hands.

It is another object of the present invention to provide an improved gripping aid that is small and easily attached to and detached from different sized ball striking equipment and ball striking equipment varying in cross-sectional diameters of the handle.

Other objects of the present invention will become apparent from the description to follow and from the appended claims.

DETAILED DESCRIPTION OF THE PREFERRED EMBODIMENTS

The present invention is now described in its preferred forms. In the following description, for purposes of explanation, numerous specific details are set forth in order to provide a thorough understanding of the present invention. It will be evident, however, to one skilled in the art that the present invention may be practiced without these specific details.

Figure 1:
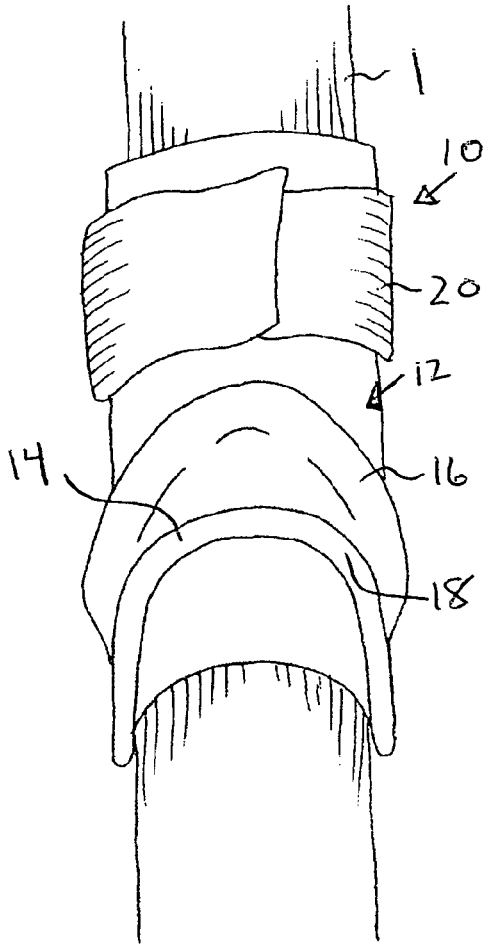
FIG. 1 is a front view of the training grip according to one embodiment of the present invention.

The training or teaching device/training or teaching grip of the present invention is shown in the figures and referred to generally at numeral 10. The training grip in accordance with the present invention is generally a device designed and configured to securely attach to the handle of an object-striking piece of sporting equipment, such as a ball-striking piece of sporting equipment, such as a baseball bat. The training grip in accordance with the present invention generally provides a finger groove area for the individual to place his or her finger when gripping the handle of the object-striking piece of sporting equipment. A first embodiment of the present invention is shown in FIG. 1 and can be employed for use by a right-handed or a left-handed individual and can easily be placed onto the handle of the sporting equipment, or easily removed therefrom. It should be appreciated that the training grip 10 in accordance with the present invention may be manufactured of any material that is malleable known in the art, as discussed further below, may be produced as a flexible plastic by a mold via thermo-injection molding.

In accordance with the present invention, the training grip may be employed with any sport requiring the use of an object-striking device, such as, but not limited to, baseball, softball, golf, and tennis. In accordance with the present invention, the training grip may additionally be employed with any conventional device requiring a proper grip, such as by not limited to household items and the like.

The details of the training grip are shown throughout the Figures. As may be seen in FIGS. 1 and 2, training grip 10 is disposed on the handle of a baseball bat 1. The training grip 10 can be easily placed onto the bat handle 1, or easily removed from the bat handle 1, as will be discussed in greater detail below. It should be appreciated that the training grip may be used with either metal or wooden type baseball bats, or with other types of sporting equipment which require a specific proper grip, such as golf clubs, softball bats, lacrosse sticks, tennis racquets and the like. The composition of the training grip 10 may be any type of known natural or synthetic flexible and resilient material conventional in the art, including but not limited to a flexible and resilient hard or soft rubber, a flexible and resilient hard or soft vinyl, a flexible and resilient hard or soft silicone, a flexible and resilient hard or soft neoprene and a flexible and resilient hard or soft plastic, and may be manufactured by methods conventional in the art, such as but not limited to thermo-injection molding and the like. Other materials and methods conventional in the art could be employed for the manufacture of the training grip 10 of the present invention, and would still fall within the scope of the present invention.

Referring now to FIGS. 1-7, the details of the training grip 10 of the present invention will be shown and described. Training grip 10 comprises a substantially tube-like elongated body member 12 for connecting or securing training grip 10 to the handle of the baseball bat 1. As shown in the figures, body member 12 comprises a generally annular outer surface 12*a* and an inner surface 12*b* comprising a configuration that generally corresponds to the configuration of the sporting equipment with which training grip 10 is employed. For example, training grip 10 may comprise a body member 12 having a generally annular inner surface 12*b* (FIG. 3A) when training grip 10 is employed with a baseball bat or a softball bat which have a generally circular cross-sectional configuration, a generally hexagonal inner surface 12*b* (FIG. 3B) when training grip 10 is employed with a lacrosse stick which has a generally hexagonal cross-sectional configuration, or a rectangular annular inner surface 12*b* (FIG. 3C) when training grip 10 is employed a tennis racquet or racquetball racquet which have a generally circular rectangular-sectional configuration. It should be appreciated that the outer surface 12*a* and the inner surface 12*b* may have corresponding cross-sectional configurations, or may have different configurations so long as inner surface 12*b* generally corresponds to the shape of the corresponding sporting equipment. In other words, outer surface 12*a* may be circumferential, annular or otherwise in its configuration, while inner surface 12*b* generally corresponds to the cross-sectional configuration of the corresponding sporting equipment.

Figure 5:
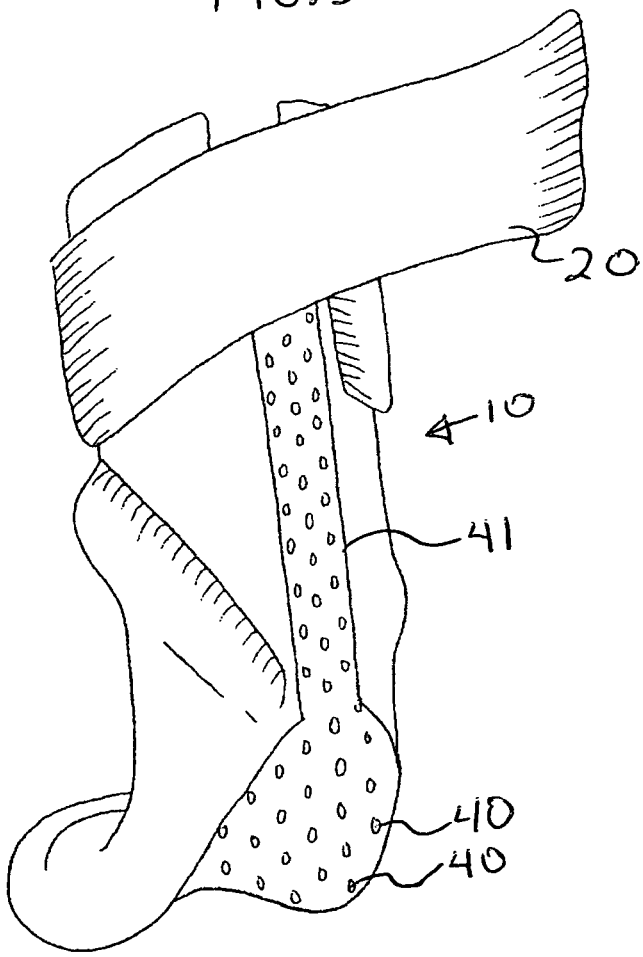
FIG. 5 is a rear perspective view of the training grip according to an alternative embodiment of the present invention.

As shown in FIGS. 3A, 3B, 3C and 4, body member 12 comprises two opposing horizontal edges 22*a*, 22*b* (FIG. 4) extending from the top end of body member 12 to the bottom end of body member 12. Horizontal edges 22*a*, 22*b* define a space 22*c* by which the flexible body member 12 may be opened to facilitate the placement of training grip 10 onto the corresponding sporting equipment. It should be appreciated that training grip 10 can comprise an alternative embodiment in which body member 12 is devoid of horizontal edges 22*a*, 22*b* in which case body member 12 is a singular piece of material which may be slid onto the sporting equipment over an end of the sporting equipment. Space 22*c* can also serve as an alignment guide for properly aligning training grip 10 into proper position on the handle of the bat 1, or other sporting equipment. In an alternative embodiment, training grip 10 may comprise an optional alignment device 41 (FIG. 5) to facilitate properly aligning training grip 10 into proper position on the handle of the bat 1, or other sporting equipment. Training grip 10, when in use, aligns with the central vertical axis of the handle. It should be appreciated that alignment device 41 may be any shape or size as conventional in the art. As shown in FIG. 5, alignment device 41 comprises edges 22*a*, 22*b* which define space 22*c*. However, it should also be appreciated that alignment device 41 can comprise any such device conventional in art and need not be limited to straight edges, such as edges 22*a*, 22*b*.

Figure 2:
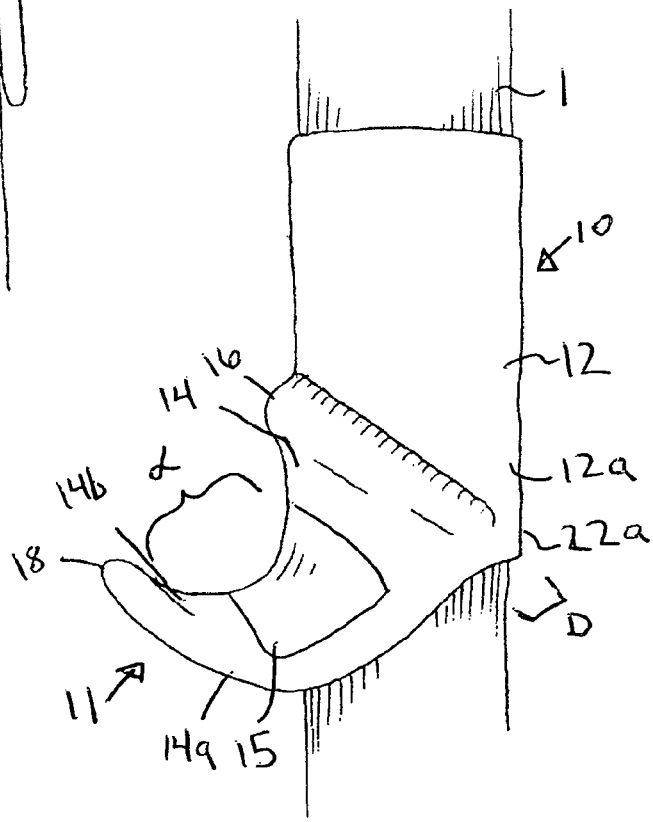
FIG. 2 is a side view of the training grip of the present invention.
Figure 3A:
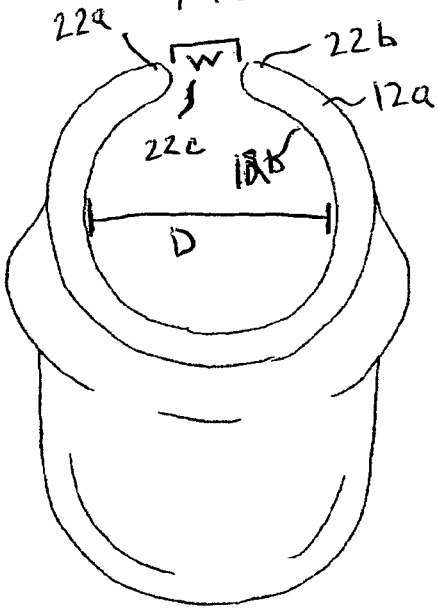
FIGS. 3A-3C are top views of the training grip according to one embodiment of the present invention having various alternative cross-sectional configurations.
Figure 3B:
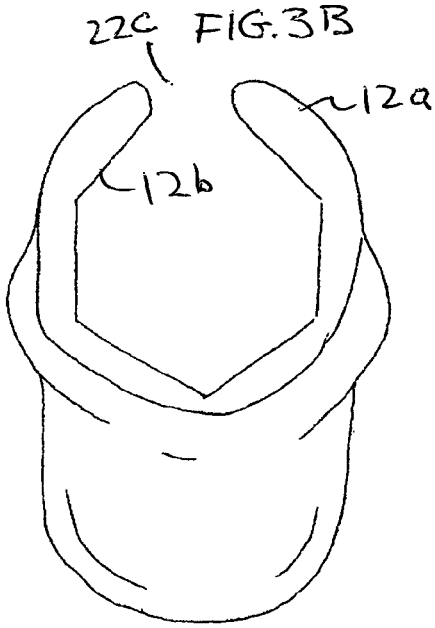
Figure 3C:
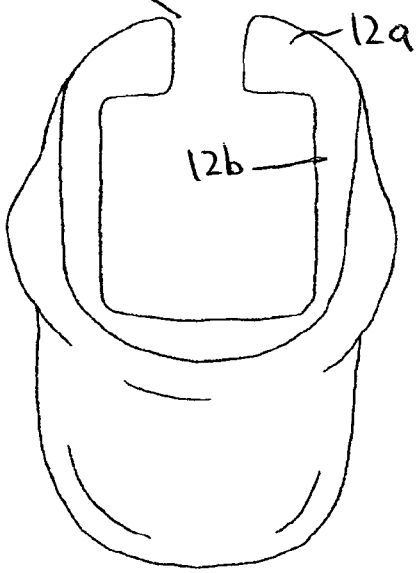
Figure 4:
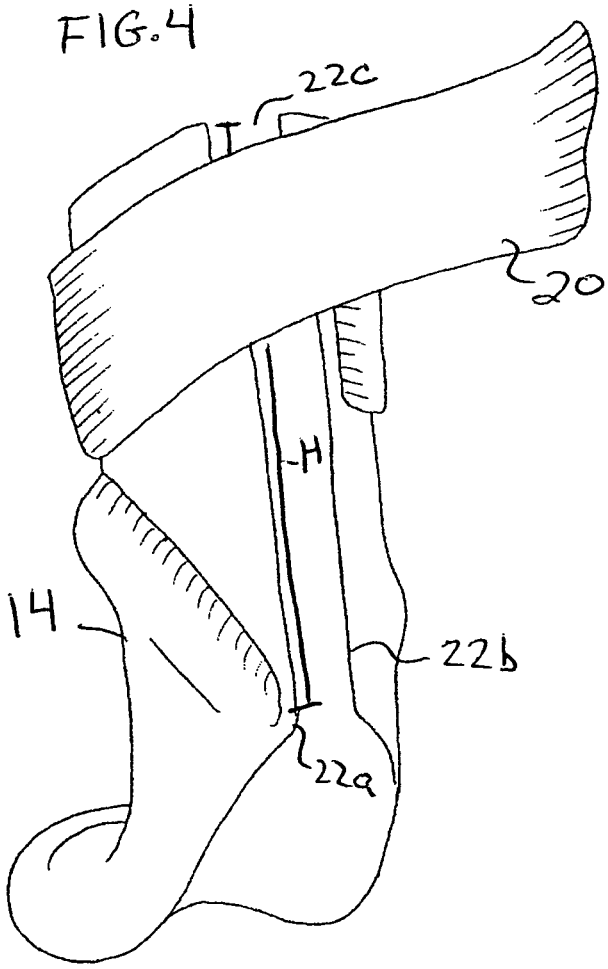
FIG. 4 is a rear perspective view of the training grip according to one embodiment of the present invention.

Still referring to FIGS. 1-9, training grip 10 comprises a saddle 11 having a at least one ridge 16 and a lip 18 which define a trigger finger (or index finger) receiving area 14, as will be explained further below. Trigger finger receiving area 14 extends downwardly and outwardly in a curved manner from body member 12, the curved portion of trigger finger receiving area 14 being a groove 14*b* (FIG. 2) for directly receiving and accommodating the trigger finger of the individual. In particular, trigger finger receiving area 14 comprises an edge 14*a* which extends downwardly and outwardly from the horizontal edges 22*a*, 22*b* of body member 12 at the bottom end of body member 12. Edge 14*a* of trigger finger receiving area 14 extends downwardly and outwardly in a curved manner to form a defined curved lip 18 of the trigger finger receiving area 14 (FIG. 2).

Figure 7:
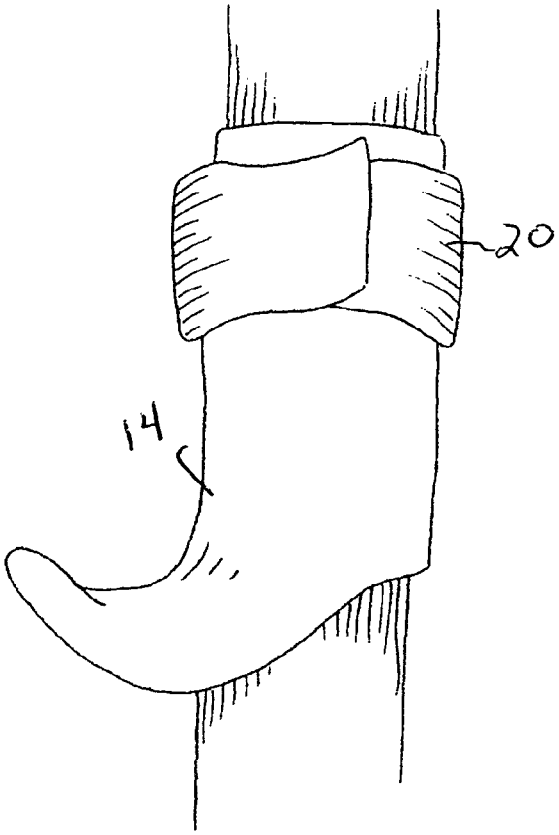
FIG. 7 is a side view of the training grip according to another alternative embodiment of the present invention.
Figure 6:
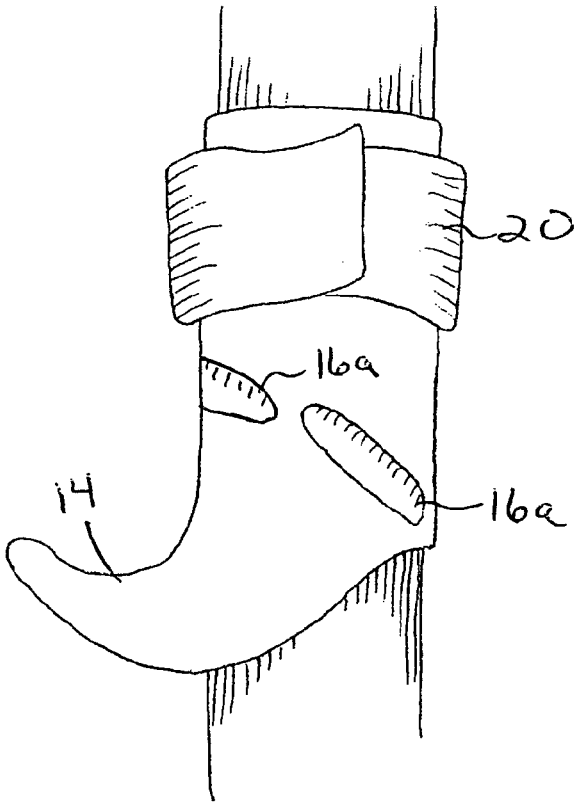
FIG. 6 is a side view of the training grip according to an alternative embodiment of the present invention.

Trigger finger receiving area 14 further comprises ridge 16 at the upper end of trigger finger receiving area 14. Ridge 16 may comprise a generally curved or arcuate configuration and defines the separation of trigger finger receiving area 14 from body member 12, and further defines the area, in combination with curved lip 18, for receiving the individual's trigger finger (index finger) at the trigger finger receiving area 14 during use of training grip 10. As shown in FIG. 2, ridge 16 may advantageously comprise a single arcuate ridge 16. It should be appreciated that, in alternative embodiments of the present invention, ridge 16 can comprise multiple smaller ridges or nodules 16*a* which in combination form a generally curved or arcuate configuration (FIG. 6). In yet another alternative embodiment, trigger finger receiving area 14 can be devoid of ridge 16 (FIG. 7).

In accordance with the present invention, trigger finger receiving area 14 angles outwardly from body member 12 at an angle ($\alpha$ in FIG. 2) in the range of about between 35°-55° relative to the handle of the bat 1. In accordance with the present invention, the width (D in FIG. 2) of the groove 14*b* of trigger finger receiving area 14 is in the range of about between 0.20-1.50 inches. In accordance with the present invention, the width of space 22*c* defined by horizontal edges 22*a*, 22*b* is in the range of about 0.25-1.25 inches (W in FIG. 3A). In accordance with the present invention, horizontal edges 22*a*, 22*b* of body member 12 comprise a height in the range of about 2-4 inches (H in FIG. 4). In accordance with the present invention, the cross-sectional diameter of body member 12 is in the range of about 0.5-1.5 inches (D in FIG. 3A).

Trigger finger receiving area 14 of training grip 10 may further comprise an optional receiving pad or finger support 15 (FIG. 2) for providing an additional resting or support pad for the trigger finger during use of training grip 10. Optional receiving pad 15 may comprise the same material as training grip 10, or a different material and may be a separate piece from or integral with training grip 10. Optional receiving pad 15 may comprise any material known natural or synthetic material conventional in the art, including but not limited to rubber, vinyl, plastic, neoprene, silicone, gel, fluid, cloth, foam, woven materials or non-woven materials, and the like. It should be appreciated that finger support 15 comprises the same or at least a generally corresponding curvature as that of trigger finger receiving area 14.

Training grip 10 further comprises an optional securing device 20 for securing training grip 10 to the handle of the bat 1 in a tight manner to prevent slipping or loosening and which can facilitate easily application and removal of training grip 10 to and from the handle of the bat 1. It should be appreciated that securing device 20 may be any securing device conventional in the art, such as a strap secured by a buckle, a strap secured by a hook-and-loop arrangement, a strap secured by at least one snap and a strap secured by an adhesive. Securing device 20 may be secured directly onto training grip 10 via any conventional manner know in the art, such as an adhesive on the side of securing device 20 directly in contact with training grip 10 or in an integral manner with training grip 10 at body member 12. As shown in the figures, securing device 20 wraps around training grip 10 and the handle of the bat 1 when training grip is in use and is subsequently secured via a hook-and-loop arrangement (FIG. 1). A securing device 20 in the form of a hook-and-loop arrangement also facilitates the securing of training grip 10 onto any type of handle regardless of the cross-sectional configuration of the handle (i.e., round, hexagonal, rectangular, etc.) or any sized handle. A securing device could be omitted if a sufficiently tight wrap of body member 12 is achieved. This could be by way of the strength of the material in a wrapping direction, by the incorporation of a spring-like material such as a C-shaped metal inserts in body material, etc.

In an alternative embodiment of the present invention, training grip 10 further comprises a plurality of nodules, ribs or protrusions 40 on the inner surface 12*b* of training grip 10. As shown in FIG. 5, plurality of nodules, ribs or protrusions 40 may comprise any types of nodules, ribs or protrusions conventional in the art and may comprise the same material as that of training grip 10, or a different material. Nodules, ribs or protrusions 40 provide additional surface area to inner surface 12*b* for aiding in the securing of training grip 10 to the handle of the bat 1, and to prevent any slipping or sliding during use. It should be appreciated that plurality of nodules, ribs or protrusion 40 may comprise any general shape conventional in the art, including but not limited to round, oval, diamond, square and the like. These other configurations of plurality of nodules or protrusions 40, of course, would also fall within the scope of this invention, and the present invention is not limited to nodules or protrusions having any particular shape.

Figure 8:
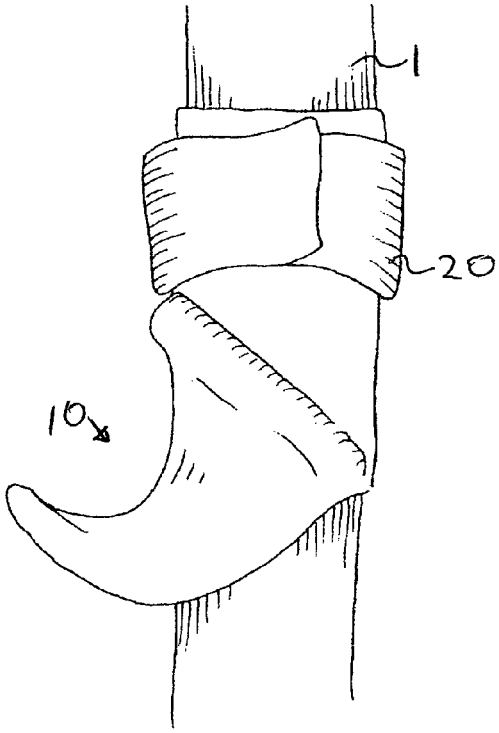
FIG. 8 is a side view of the training grip of the present invention as shown applied to a baseball bat handle.
Figure 9:
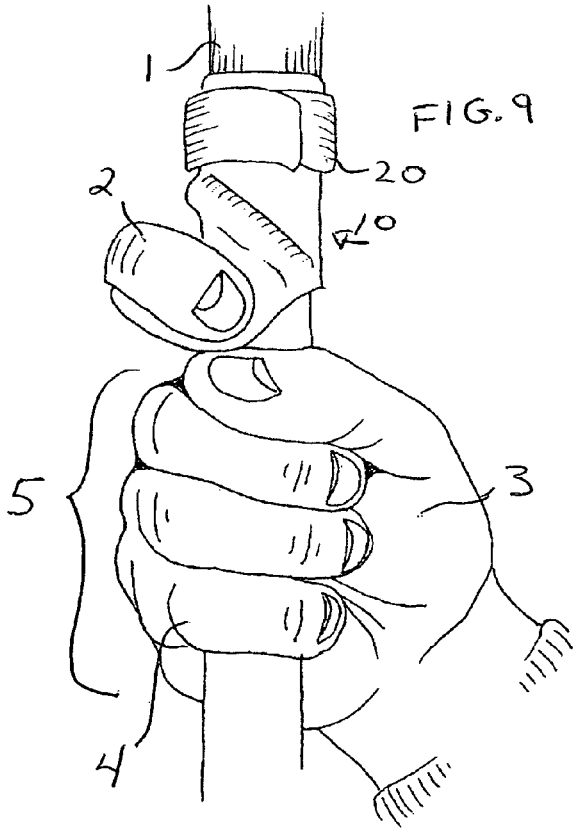
FIG. 9 is a side view of the training grip of the present invention as shown applied to a baseball bat handle and during use by an individual.

Referring now to FIGS. 8 and 9, training grip 10 is shown as applied to the handle of the baseball bat 1 (FIG. 8) for use by an individual, and during the actual use by the individual (FIG. 9) with a baseball bat. As shown in FIGS. 8 and 9, the individual's trigger finger/index finger 2 is in position at trigger finger receiving area 14. As shown in FIGS. 8 and 9, securing device 20 is secured, such as by an adhesive, to training grip 10, and wraps around the handle of the bat 1 to secure training grip 10 tightly to the handle of the bat 1. The placement of the user's trigger finger 2 at trigger finger receiving area 14 forces the user's other fingers 4 into a proper grip formation on the handle of the bat 1, such that the remaining fingers 4 wrap around the handle of the bat 1 accordingly. As can be seen in FIG. 9, the proper grip by the individual on the handle of the bat 1 includes a substantially straight alignment of the individual's knuckles 5 of the remaining fingers 4. The handle of the bat 1 is thus not resting in the palm of the hand 3 of the individual.

Still referring to FIG. 9, the user is shown properly gripping the bat with the right hand (i.e., top hand for a right-handed individual). The training grip is slipped onto the handle of a ball-striking device, such as the baseball bat, by sliding the handle of the bat through the open slot or space 20*c* of the body member. The individual would then adjust the training grip to the desired alignment by referring the alignment guide, if present, or by referring the alignment of the slot or space, in relationship to the baseball bat handle. The individual may easily adjust the training grip accordingly to the desired position on the baseball bat handle. The securing device, such as a strap, may then be wrapped tightly around the body member of the training grip and in turn the handle of the baseball bat, and can be tightly secured such as by a hook-and-loop arrangement. By a right-handed swinging player, hooking the right trigger finger, into the finger groove 14*b* while griping the handle 1, the player will feel a sensation of the proper grip position of the trigger finger and the rest of the right hand. The player will also feel a sense of control in the grip during the swing because of the grip position that the training grip forces the hand into. With the trigger finger hooked into the proper angle on the handle 20, the bottom three fingers of the individual's hand are placed into a position to directly grip the handle and causing the handle of the bat to not rest in the palm portion of the individual's hand. It should be appreciated by one skilled in the art that an individual's grip on the handle of a ball-striking device, such as a baseball bat, should take place in the finger portion of the hand rather than the palm of the hand. The training grip also provides a consistent grip alignment onto the baseball bat handle, which in turn helps the individual produce a consistent swing. The individual would then swing the ball-striking device while keeping the trigger finger hooked in place in the finger groove of the training grip. The player would use the present invention in a manner to practice the grip and swing for his or her respective sport.

Figure 10:
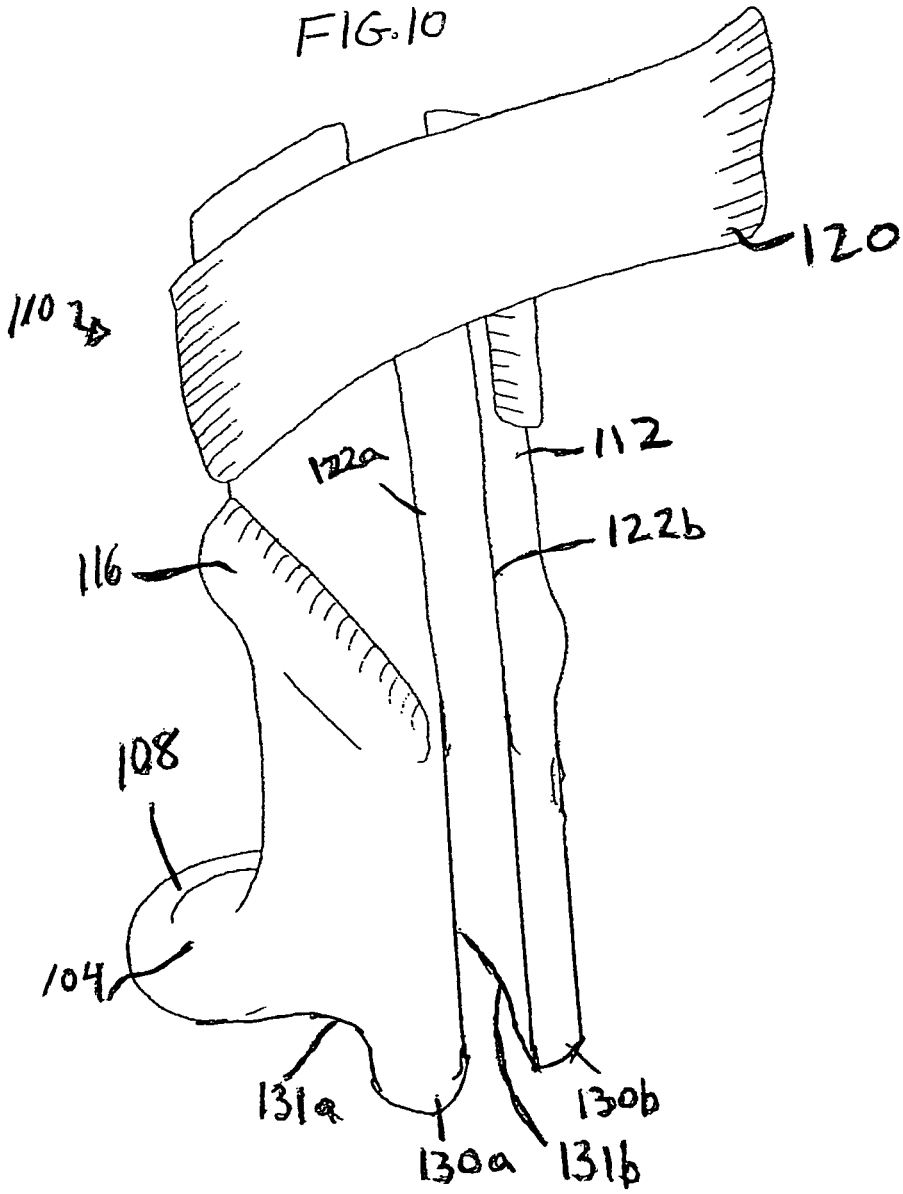
FIG. 10 is a rear perspective view of the training grip of an alternative embodiment of the present invention as shown for use with a golf club handle.
Figure 11:
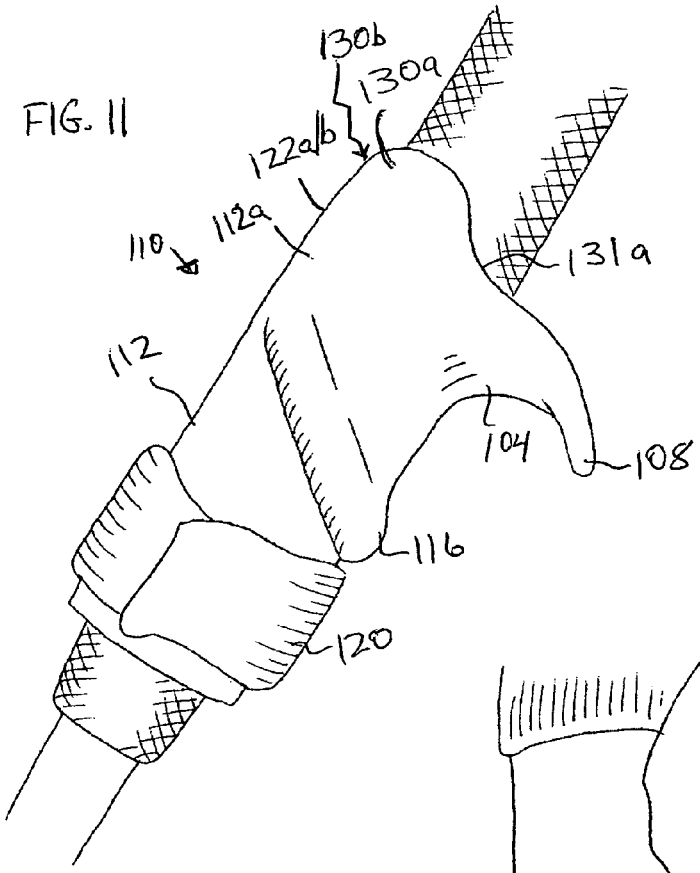
FIG. 11 is a side view of the training grip of an alternative embodiment of the present invention as shown applied to a golf club handle.
Figure 12:
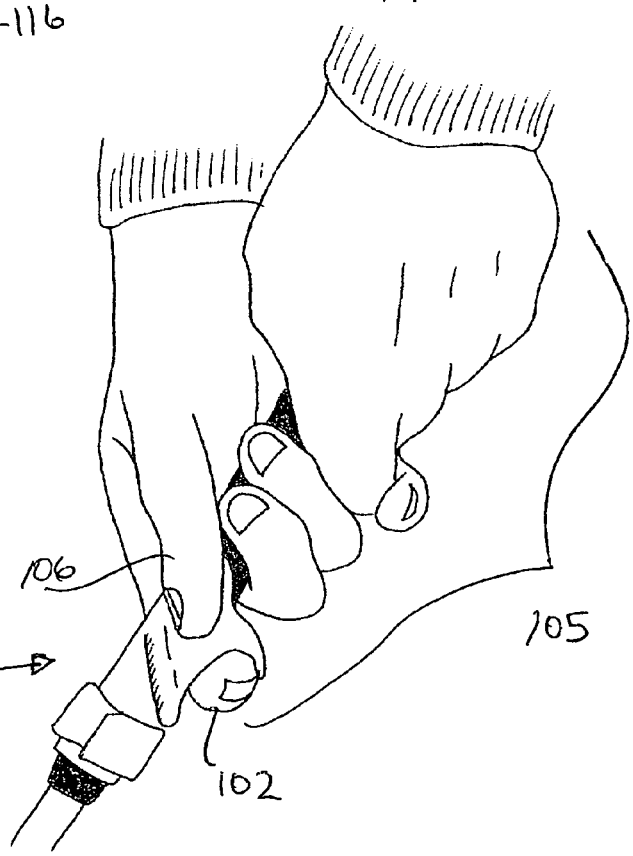
FIG. 12 is a side view of the training grip of an alternative embodiment of the present invention as shown applied to a golf club handle and during use by an individual.

Turning now to FIGS. 10, 11 and 12, an alternative embodiment of the training grip is shown and described and referred to generally at numeral 110. Training grip 110 comprises the same overall features and dimensions of training grip 10 described above the details of which are incorporated herein by reference. However, training grip 110 is modified or adapted specifically for use with a golf club.

As shown in FIGS. 10, 11 and 12, training grip 110 comprises a securing member 112, a trigger finger receiving area 114, a curved lip or edge 118, a substantially curved or arcuate ridge 116, with the edge 118 and ridge 116 defining the dimensions of trigger finger receiving area 114, an outer surface 112*a* of securing member 112 and opposing horizontal edges 122*a*, 122*b* defining the opposing edges of securing member 112.

Horizontal edges 122*a*, 122*b* form two opposing curved boot areas 130*a*, 130*b*, each of which in turn curves and extends upwardly towards edge 118 for defining the curved lip or edge 118. The upwardly extending edge in turn defines a curved space or indentation 131*a*, 131*b* for receiving and accommodating the individual's thumb during use of training grip 110 while playing golf. It should be appreciated that thumb accommodating space 131*a*, 131*b* receives and accommodates the individual's thumb 106 on the lower hand (i.e., strong hand) depending on whether the individual is employing a right-handed or left-handed swing.

In the same manner as described above, the placement of the individual's trigger finger 102 in trigger finger receiving area 114 and the individual's thumb 106 at the thumb accommodating space 131*a*, 131*b* causes the individual's remaining fingers 105 to be correctly aligned, thus causing a correct grip on the golf club during use.

It will be evident to one skilled in the art that numerous modifications and other embodiments could be constructed that would be different from that which is herein described and depicted, but that would still fall within the scope of this invention. Thus, this disclosure is not intended to be so limiting, but rather illustrative, of one embodiment of the present invention. The scope of the invention is disclosed in the following claims. What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

I claim:

1. A grip teaching device for use with the handle of sporting equipment, said grip teaching device comprising:

an elongated body member being generally cylindrical and having an inner surface configured for receiving a handle portion of a corresponding sporting equipment, and an outer surface; and a generally curved saddle extending substantially outwardly from said elongated body member, said saddle comprising:

at least one bulging arcuate ridge at the upper portion of the saddle, said at least one bulging arcuate ridge being substantially adjacent to said elongated body member for defining a boundary between said elongated body member and said saddle, and wherein said at least one bulging arcuate ridge bulges outwardly at the connection of said elongated body member and said saddle;

two substantially parallel curved edges extending downwardly and outwardly from said at least one arcuate ridge to define a lip of the saddle;

a bottom side; and an index finger receiving area, wherein the combination of said at least one bulging arcuate ridge and said curved edges extending downwardly and outwardly from said at least one bulging arcuate ridge for defining said lip define said index finger receiving area.

2. The grip teaching device according to claim 1, wherein said body member comprises a top edge and two horizontal edges extending from the top edge of said body member to each end of said at least one bulging arcuate ridge for defining a space between each horizontal edge for facilitating placement on and removal from of said grip training device to the handle of the sporting equipment.

3. The grip teaching device according to claim 2, wherein the width of said space is in the range between ¼ inch and 1¼ inches.

4. The grip teaching device according to claim 1, further comprising a securing device for securing said grip teaching device to the handle of the sporting equipment.

5. The grip teaching device according to claim 4, wherein said securing device is selected from the group of securing devices consisting of a strap secured by a buckle, a strap secured by a hook-and-loop arrangement, a strap secured by at least one snap, and a strap secured by an adhesive.

6. The grip teaching device according to claim 1, wherein said grip teaching device comprises at least one material selected from the group consisting of rubber, vinyl, silicone, neoprene and plastic.

7. The grip teaching device according to claim 1, wherein said at least one bulging arcuate ridge consists of a single continuous bulging arcuate ridge.

8. The grip teaching device according to claim 1, wherein said at least one bulging arcuate ridge comprises a configuration selected from the group consisting of at least two ridges that in combination comprise a generally arcuate configuration and a plurality of nubs that in combination comprise a generally arcuate configuration.

9. The grip teaching device according to claim 1, wherein said inner surface of said elongated body member and said outer surface of said elongated body member each comprise a cross-sectional configuration selected from the group consisting of cylindrical, circular, ovoid, triangular, octagonal, square and rectangular.

10. The grip teaching device according to claim 9, wherein the cross-sectional configuration of said inner surface of said elongated body member and said outer surface of said elongated body member are the same or different.

11. The grip teaching device according to claim 10, wherein the cross-sectional configuration of said inner surface of said elongated body member corresponds to the cross-sectional configuration of a handle of a respective sporting equipment for which said grip teaching device receives.

12. The grip teaching device according to claim 1, wherein said index finger receiving area comprises a distance of about ¼ inch to about 1½ inches measured from said at least one bulging arcuate ridge to said lip of the saddle.

13. The grip teaching device according to claim 1, wherein the interior diameter of said elongated body member is in the range of about ½ inch to about 1½ inches.

14. The grip teaching device according to claim 1, wherein said elongated body member comprises a height in the range of about 2-5 inches.

15. The grip teaching device according to claim 2, further comprising an alignment guide at said space for aligning said grip teaching device onto the sporting equipment relative to the central vertical axis of the handle of the sporting equipment.

16. The grip teaching device according to claim 1, wherein said index finger receiving area further comprises a finger support comprising at least one material selected from the group of materials consisting of rubber, vinyl, plastic, gel, fluid, cloth, foam, wovens and non-wovens, and wherein said finger support comprises a corresponding curvature and configuration as said index finger receiving area.

17. The grip teaching device according to claim 1, wherein said grip teaching device is applied to the handle of a sporting equipment selected from the group consisting of a baseball bat, a softball bat, a lacrosse stick, a tennis racquet, a golf club, a cricket bat, a racquetball racquet and a squash racquet.

18. The grip teaching device according to claim 2, wherein, when said grip teaching device further comprises two substantially parallel curved edges extend downwardly from said at least one arcuate ridge at a length, and curve upwardly towards said lip, and further define at least one space for accommodating a thumb.

19. The grip teaching device according to claim 1, further comprising a plurality of gripping elements selected from the group consisting of nodules, ribs and protrusions on the inner surface of said elongated body member for aiding in the securing of said grip training device to the handle of the corresponding sporting equipment during use and to prevent slipping or sliding of said grip teaching device during use.

20. The grip teaching device according to claim 19, wherein said plurality of gripping elements comprise a configuration selected from the group consisting of round-shaped, oval-shaped, diamond-shaped and square-shaped.

* * * * *